United States Patent [19]

Prasil et al.

[11] Patent Number: 4,700,564

[45] Date of Patent: Oct. 20, 1987

[54] DEVICE FOR AUTOMATICALLY IDENTIFYING CATENARY POSTS OF A RAILWAY TRACK TO LOCATE FAULTS DETECTED ON THE RAILWAY TRACK

[75] Inventors: Bernard Prasil, Paris; Jean-Pierre Turbe, Nanteuil-les-Meaux, both of France

[73] Assignees: Societe Nationale des Chemins de Fer Francais; Matix-Industries, both of Paris, France

[21] Appl. No.: 890,182

[22] PCT Filed: Nov. 20, 1985

[86] PCT No.: PCT/FR85/00326

§ 371 Date: Jul. 9, 1986

§ 102(e) Date: Jul. 9, 1986

[87] PCT Pub. No.: WO86/03170

PCT Pub. Date: Jun. 5, 1986

[30] Foreign Application Priority Data

Nov. 23, 1984 [FR] France ..... 84 17870

[51] Int. Cl.[4] ..... G01B 5/28

[52] U.S. Cl. ..... 73/146; 346/33 F

[58] Field of Search ..... 73/146, 105; 346/33 F, 346/33 P

[56] References Cited

U.S. PATENT DOCUMENTS

| | | | |
|---|---|---|---|
| 2,740,090 | 3/1956 | Dionne | 346/33 F |
| 3,634,866 | 1/1972 | Meyer | 346/59 |
| 3,754,275 | 8/1973 | Carter et al. | 346/33 P |
| 3,967,194 | 6/1976 | Beaver et al. | 346/33 P |
| 4,148,027 | 4/1979 | Nowogrodzki | 73/146 |

*Primary Examiner*—Donald O. Woodiel

*Attorney, Agent, or Firm*—Sughrue, Mion, Zinn, Macpeak and Seas

[57] ABSTRACT

The invention relates to the location of singular points in the automatic control of railway tracks. According to a possible embodiment, the railway carriage (11) carrying the control equipments is provided with radar antennas (25*a*, 25*b*) orientated to detect catenary posts (13) and more particularly their registration arms.

8 Claims, 3 Drawing Figures

DEVICE FOR AUTOMATICALLY IDENTIFYING CATENARY POSTS OF A RAILWAY TRACK TO LOCATE FAULTS DETECTED ON THE RAILWAY TRACK

The invention pertains to a process for monitoring the condition of railrod tracks and more specifically has the object of the identification of defects detected by monitoring equipment on board a railroad car moving on the tracks to be checked to allow maintenance crews to subsequently find these defects; the invention also pertains to a monitoring system for the implementation of said process.

[A method]is known to monitor railroad tracks by running a special railroad car on these tracks, with said car comprising monitoring equipment of all types, especially ultrasound systems and Foucault current sensors.

All of this monitoring equipment is implemented to detect specific types of defects, as the car progresses: internal cracks for ultrasound detectors, cracks issuing on the surface of the upper rail face for Foucault currents, etc. . . A data processing system is also on board to process the information sent by all the sensors, to correlate said information and to thus determine the nature of the defect while distinguishing among the signals received those which correspond to a singular point (fishplated joint or rail, welded joint) and not a defect.

Other information pertaining to the general condition of the tracks can be gathered by adapted equipment and processed by the computer, such as, for example, the stability of the tracks or the quality of the rail shunting by axles which affect the automatic operation of the signals.

The computer is connected to equipment which records and displays all of this information, such as, for example, a printer, which sends a series of messages which are later used by a maintenance crew. An operator monitoring the acquisition of the data can also use a keyboard to input information to indicate the singular points of the tracks (tunnels, switches) facilitating the identification of defects by the maintenance crew.

Moreover, the precise identification of a defect is ensured by paint markings ordered automatically from the car by a control system. However, these traces of paint are relatively difficult to find if the information recorded does not comprise a sufficient number of the aforementioned singular points.

However, the automation of the detection of defects and the improvement of the performance of the corresponding equipment make it possible to reduce the checking time, by increasing the speed of the car carrying this equipment. As such, it becomes highly difficult for the operator to clearly and precisely note the nature and location of all singular points he identifies. The object of the invention is to allow an automatic collection of the singular points, facilitating the location of the paint marks.

More specifically, the invention thus pertains to a process for monitoring the condition of railroad tracks of the type consisting of moving the monitoring equipment in a car moving on said tracks and recording the signals emitted by said monitoring equipment gradually as said car progresses, characterized in that it consists of pointing a radar on board said car towards characteristic structures located along said tracks, recording the corresponding echo signals, simultaneously with said signals, to contribute to the subsequent identification of defects detected in said railroad tracks.

Among the characteristic structures which can be identified by this equipment, one can cite bridges, tunnels and especially overhead contact line posts which present the advantage of obtaining clearly characteristic echoes constituting a relatively precise scanning of the railroad tracks, since [said posts]are placed at regular intervals on virtually all electrified tracks.

The invention also pertains to a monitoring system for railroad tracks comprising a car moving on said tracks in which continuous monitoring equipment for said tracks as well as means for recording signals sent by said monitoring equipment is installed, characterized in that said car carries at least one radar device whose antenna is oriented in a predetermined direction corresponding to the position of characteristic structures located near the tracks and in that said recording equipment is connected to record the echo signals developed by the radar in a correlative manner with the signals sent by the monitoring equipment.

The invention and other advantages thereof will appear more clearly through the following description which is given solely as an example and which is presented in reference to the non-limitative drawing below, in which.

Figure 1:
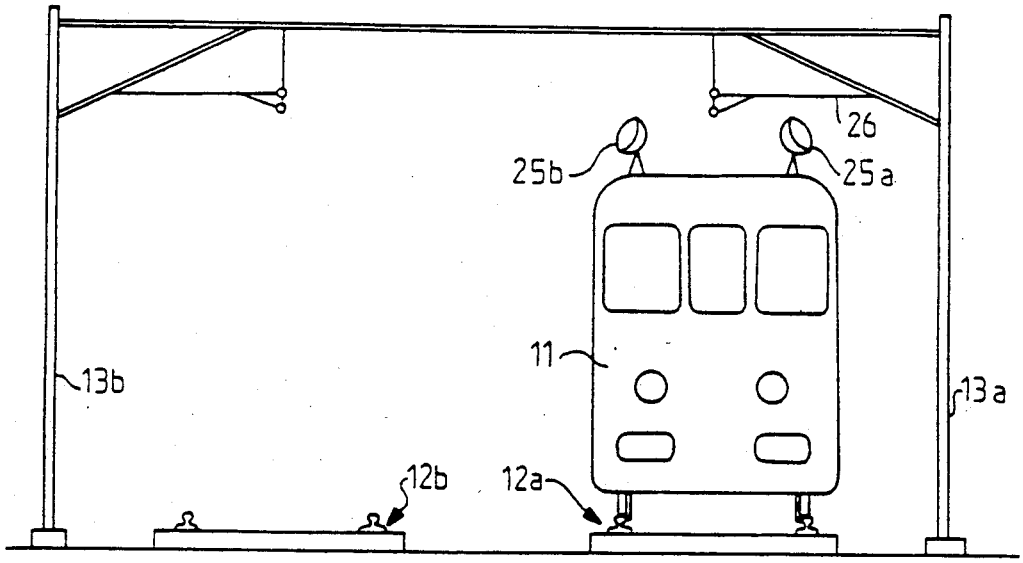
FIG. 1 is a schematic representation of a monitoring car moving on the railroad tracks being checked, with said car being endowed with radar equipment according to the invention.
Figure 2:
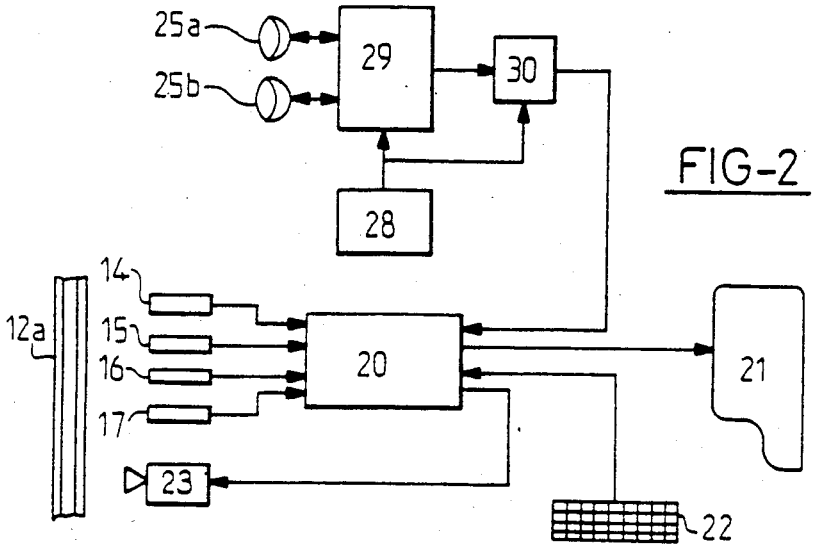
FIG. 2 is a block diagram of the installation.

With reference to the drawing, the monitoring system described is installed on board a car (11) which moves on the railroad tracks (12*a*) to be monitored. Two alignments of overhead contact line posts (13*a*), (13*b*) are respectively established along two parallel railroad tracks (12*a*), (12*b*). A certain number of sensors (14), (15), (16), (17) . . . are installed in the car to monitor the rails. These are mainly ultrasound or Foucault current sensors, as mentioned above. The signals emitted by said sensors are processed and managed by a computer (20), which controls a printer (21) whose role is to record and display the information which indicates the defects and their approximate location by singular points. Some of these singular points can be recorded directly by an operator inspecting the tracks from the car (11). For this purpose, the operator utilizes a keyboard (22) connected to the computer - printer system. The computer also controls a marking device (23) which sprays a small amount of paint on the railroad tracks whenever a defect is detected by one of the sensors (14–17) and is recognized as such by the computer, according to criteria and an analytical process which are known, which are not a part of the invention.

According to the invention, the car (11) carried in its upper part at least one and preferably two radar antennae (25*a*), (25*b*), in this case, in the form of paraboloids.

These antennae are oriented in predetermined directions (symmetrically on both sides of the car and towards the front) corresponding to the possible position of characteristic structures located near the tracks. According to the example, the antenna (25*a*) is pointed in the direction of the upper part of the overhead contact line posts (13*a*) and receives the corresponding echoes, while the signals possibly emitted by the antenna (25*b*) give no usable echo. On the other hand, if the car were running on the tracks (12*b*), the situation would be reversed, with the antenna (25*b*) providing echo signals representative of the presence of the overhead contact line [posts] (13*b*).

Figure 3:
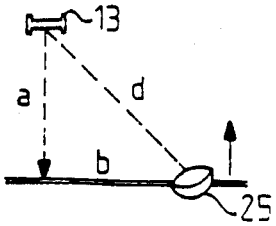
FIG. 3 illustrates the mode of operation of the radar equipment.

In all cases, the alignment of the overhead contact line posts closest to the car (11) is detected. Each antenna (25*a*), (25*b*) is oriented so that its radar beam is more specifically directed towards the steady braces (26) of the overhead contact line posts of the corresponding alignment. The radar equipment connected to the antennae is conventional and comprises equipment to measure the Doppler effect resulting from the displacement of the car (11). Indeed, since the orientation of the antenna is fixed and there is little variation in the distance b between the overhead contact line posts and the railroad tracks, the distance d between the overhead contact line post steady braces and the antenna when the echo is being formed (see FIG. 3) is a constant and the variation of the corresponding frequency fo is known if the speed of the car (11) is stabilized at a predetermined value (about 40 km/hour in practice).

The system can thus, for example, comprise an HF generator (28) connected to a broadcast - receiving device (29), whose echo signal emission is connected to frequency comparing equipment (30) also connected to the generator (28). Any variation from the predetermined frequency fo is interpreted as the detection of an overhead contact line post and causes a control order to be sent to the printer (21). The system is programmed to automatically correct the location of the overhead contact line [post]by distance a due to the forward orientation of the antenna (see FIG. 3). Once this systematic error correction is made, the residual locating error depends in practice only on the variations in the distance of the overhead contact line post steady braces from the tracks (distance b); this distance is about 1 to 2 meters. Of course, other antennae (25) can be provided, pointed towards other characteristic structures such as bridges and tunnels.

We claim:

1. Process for monitoring the condition of railroad tracks, of the type which consists of moving monitoring equipment on a railroad car (11) moving on said tracks (12*a*) and recording (21) the signals emitted by said monitoring equipment (14–17) gradually as said car moves forward, characterized in that it consists of pointing a radar (25*a*) on board said car towards characteristic structures (13) located along said tracks, recording (21) the corresponding echo signals simultaneously with said signals, to contribute to the subsequent identification of defects detected on said railroad tracks.

2. Monitoring process according to claim 1, characterized in that the aforementioned characteristic structures are overhead contact line posts (13*a*) placed beside said railroad tracks.

3. Monitoring process according to claim 2, characterized in that said radar beam is pointed towards the steady braces (26) of said overhead contact line posts.

4. Process according to one of claims 2 or 3, characterized in that, with the speed of said car (11) being constant, said overhead contact line posts are detected by using the Doppler effect.

5. System for monitoring railroad tracks comprising a car (11) moving on said tracks in which continuous monitoring equipment (12*a*) for said tracks and recording equipment (21) for the signals emitted by said monitoring equipment are installed, characterized in that said car carries at least one radar device (25*a*, 28–30) whose antenna (25*a*) is oriented in a predetermined direction corresponding to the position of characteristic structures (13*a*) located near the tracks and in that said recording equipment is connected to record the echo signals made by the radar in a correlative manner with the signals emitted by the monitoring equipment.

6. Monitoring system according to claim 5 characterized in that the antenna (25*a*) of said radar equipment is pointed in the direction of the overhead contact line posts, preferably towards the steady braces (26) thereof.

7. Monitoring system according to claim 6 characterized in that said radar equipment (25, 28–30) is the type which comprises equipment to measure the Doppler effect.

8. Monitoring system according to one of claims 6 or 7 characterized in that it comprises two antennae (25*a*, 25*b*) oriented towards both sides of the tracks and adjusted in an essentially identical manner corresponding to the alignment of the overhead contact line posts closest to the tracks on which said car is running.

* * * * *